US005630531A

United States Patent [19]

Gaucher

[11] Patent Number: 5,630,531

[45] Date of Patent: May 20, 1997

[54] DEVICE FOR PACKAGING A PRODUCT WITH A MANUAL PUMP FOR DISPENSING INDIVIDUAL METERED AMOUNTS

[75] Inventor: Denis Gaucher, Annecy, France

[73] Assignee: Societe d'Innovation Recherche Plastique, Annecy, France

[21] Appl. No.: 511,441

[22] Filed: Aug. 4, 1995

[30] Foreign Application Priority Data

Aug. 8, 1994 [FR] France ..... 94 09815

[51] Int. Cl.[6] ..... B65D 35/54

[52] U.S. Cl. ..... 222/96; 222/105; 222/321.9; 222/386.5

[58] Field of Search ..... 222/95, 96, 105, 222/183, 321.8, 321.9, 386.5, 494

[56] References Cited

U.S. PATENT DOCUMENTS

| | | | |
|---|---|---|---|
| 4,469,250 | 9/1984 | Evezich | 222/95 X |
| 5,273,191 | 12/1993 | Meshberg | 222/105 |
| 5,292,033 | 3/1994 | Gueret | 222/95 |
| 5,305,921 | 4/1994 | Kock et al. | 222/95 |
| 5,366,115 | 11/1994 | Kersten et al. | 222/105 |

FOREIGN PATENT DOCUMENTS

| | | |
|---|---|---|
| 2710984 | 9/1978 | Germany . |
| 0473994 | 3/1992 | Germany . |
| WO-A-9215517 | 9/1992 | WIPO . |
| WO-A-9312013 | 6/1993 | WIPO . |
| WO-A-9324392 | 12/1993 | WIPO . |

*Primary Examiner*—Joseph Kaufman
*Attorney, Agent, or Firm*—Larson and Taylor

[57] ABSTRACT

The volume (12) between the deformable container (1) containing the product and the rigid outer container (2) receives outside air, at least when the pump (15) is actuated, via orifices (18, 20) made in the pump body (13) and the neck (17) of the deformable container (1) and via grooves (21) for the passage of air into the neck (16) of the outer container (2). Confinements mechanisms, such as a cap (3) mounted in a leaktight manner on the device, or a seal (4) forming a non-return valve against the orifice (18) for air intake, or, alternatively, a special stop limiting the displacement of the piston (6) of the pump (15), prevent the leakage towards the outside, via the reverse path, of vapors and/or gases which have migrated from the inside of the container (1) into the volume (12) between the containers (1, 2), when the pump (15) is not actuated.

13 Claims, 4 Drawing Sheets

DEVICE FOR PACKAGING A PRODUCT WITH A MANUAL PUMP FOR DISPENSING INDIVIDUAL METERED AMOUNTS

FIELD OF THE INVENTION

The present invention relates to the technical field of packing and, more especially, to that of packaging a product intended to be dispensed in individual metered amounts with the aid of a manual pump.

The subject of the invention is more particularly a device for packaging and dispensing individual metered amounts, and which comprises a rigid outer container accommodating at least the greater part of a deformable inner container intended to contain the product to be dispensed in individual metered amounts with the aid of a manual pump of the type without air intake, which is mounted on the open necks of the two containers.

BACKGROUND OF THE INVENTION

Packaging devices of conventional structure are known, these comprising a container on which a manual pump for dispensing the product contained in the container is fitted. A pump of this type generally includes a plunger making it possible, through simple pressure from the user's finger, to cause the displacement of a piston in a pumping chamber, the volume of which determines the metered amount to be dispensed. A first valve makes it possible to isolate this chamber from the inner volume of the container, when the product is expelled from this chamber via a second valve, through the effect of the displacement of the piston through pressure on the plunger, and the second valve makes it possible to isolate the chamber from the outside, when this chamber is filled via the first valve with a metered amount of product originating from the inside of the container and sucked into the chamber by means of the return of the piston towards its initial position, pressing against a stop of a pump body in which the piston slides, and through the action of elastic return means.

Therefore, each time the piston returns to its initial position, obtained through the effect of the elastic return means, such as a spring, a metered amount of product is sucked into the chamber of the pump.

This suction of the product gives rise to a reduced pressure inside the container.

In order to prevent outside air from penetrating into the container in order to offset this reduced pressure, packaging and dispensing devices have been proposed which include a pump without air intake, as well as a deformable container, which contains the product to be packaged and dispensed. Each time a metered amount of product is expelled from the deformable container, the reduced pressure created contracts this deformable container around which a rigid outer container has been provided to afford mechanical protection for the deformable inner container. However, for a device produced in this way to operate, it is necessary for the deformable inner container to be able to retract.

For this reason, it is necessary to allow outside air to enter into the volume delimited between the deformable inner container and the rigid outer container.

This intake of air is generally provided in the bottom of the rigid container in which a passage is provided for this purpose, but the intake of air may also take place in the vicinity of the neck of this rigid container.

The major drawback of this type of packaging device lies in the fact that the deformable inner container, which is manufactured from plastic, must have a thin wall thickness in order to be able to deform easily, and in the fact that this results in considerable permeability of the wall of the deformable container and migration of part of the product and/or evaporation of at least one volatile component of the product to be dispensed through this flexible wall of the deformable container.

This phenomenon may be observed particularly with aqueous or alcoholic products and/or with those containing one or more volatile substances.

A gas released by the packaged product or a vapor resulting from the evaporation of a volatile phase of this product can pass through the thin wall of the deformable container and escape towards the outside via the passage reserved for the air intake.

In order to remedy this drawback, deformable containers made from relatively impermeable flexible composite materials have been proposed.

However, these materials have the disadvantages of being expensive and difficult to employ. Moreover, they are never totally impermeable and migration and/or evaporation is always noted after a reasonably long period.

A further solution to this problem already proposed consists in providing a non-return or one-way valve placed in the passage or downstream of the passage provided for the air intake.

A valve of this type permits passage in one direction only and it allows the air to enter into the volume between the two containers when the suction due to the return of the pump piston towards its rest position, pressing against a stop of the pump body, requires it, but prevents leakage towards the outside of gases and/or vapor, the presence of which in the volume between the two containers is the result of evaporation and of the passage of volatile phase(s) of the product contained in the deformable container through the thin wall of this container.

Thus, evaporation of the product and its migration towards the volume included between the two containers cease as soon as this volume reaches saturation.

However, employing non-return valves of this type requires the manufacture and mounting of at least one additional piece in order to produce this valve, which considerably increases the cost of the device.

A second drawback of this type of packaging device, comprising a manual pump without air intake fitted to an assembly of two containers, one being a deformable inner container and the other a rigid outer container, lies in the cost of manufacturing the deformable container.

The two methods currently used for manufacturing these thin-walled deformable containers are extrusion blow-moulding and injection blow-moulding of plastic.

These two methods do not make it possible to obtain all the desirable shapes of the necks of the containers, nor do they make it possible to obtain pieces at very low prices.

SUMMARY OF THE INVENTION

A first object of the invention is to remedy the principal drawback mentioned above, by proposing a structure for the packaging and dispensing device which does not require additional pieces in order to produce a non-return valve permitting the intake of outside air into the volume between the two containers and opposing the leakage of gases or vapor from this volume.

A second object of the invention is to permit the manufacture of thin-walled deformable containers using the plastic injection technique, by proposing, particularly to this end, special wall shapes which make it possible to use this technique and which also have the advantage of permitting easy insertion of the deformable container inside the rigid container, as well as the possibility of entirely emptying the deformable container of the product it contains, in packaging and dispensing devices with a manual pump according to the invention and of the type presented above.

In order to achieve the principal object of the invention, the latter proposes a device for packaging and dispensing a product, comprising a rigid outer container, with an open neck, a deformable inner container, with an open neck and which is essentially accommodated inside the outer container, and intended to contain a product to be packaged and dispensed, and a manual pump of the type without air intake into the inner container, and intended to dispense the product in individual metered amounts, and which is mounted on the neck of the outer container and in a leaktight manner on the neck of the inner container with the aid of leaktight means, the device being characterized in that the outer container has a closed bottom, the inner container has a neck which is more rigid than its deformable body, and at least one of the necks delimits at least partially, outside the leaktight means, at least one passage and/or orifice for air intake into the volume delimited between the containers, and the pump includes a body mounted on the necks of the containers and which has, outside the leaktight means, at least one orifice for air intake into the volume between the two containers, so that the passages and orifices for air intake define in succession a channel permitting the intake of external air into the volume between the two containers, at least when the pump is actuated, and the device also comprises means for confining any part of the product passing through the deformable body of the inner container from the volume internal to the latter towards the volume between the two containers, and tending to escape towards the outside via the channel for air intake, at least when the pump is not actuated.

Thus, the air can pass through this passage and these successive orifices and offset the reduced pressure created between the deformable container and the protective rigid container when the user operates the pump. Moreover, the gas or gases and/or vapor(s) resulting from evaporation of the product located in the deformable container and which has/have passed through the wall of the latter cannot escape by using this passage and these successive orifices because its/their route will be blocked by the confinement means.

In a first advantageously simple embodiment, the passage and orifices for air intake of the outer and inner containers and of the pump are in permanent communication with one another, so that the channel for air intake is permanently open, and the confinement means comprise a leaktight cap fixed removably and in a leaktight manner on the device, around the pump and the necks of the containers, and the channel for air intake opens out inside the cap when the latter is fastened on the device.

In this embodiment, confinement is therefore provided by a cap, which a device of this type generally includes, so that no additional piece is necessary.

When the device is equipped with a pump of the type comprising a piston, applied against a stop of the pump body by means for elastic return to the rest position of the pump and separated from the stop against the elastic return means by manual pressure by the user on a plunger when the pump is actuated, it is then advantageous, as in the preceding embodiment, for the passage and orifices for air intake of the outer and inner containers and of the pump to be in permanent communication with one another, so that the channel for air intake is permanently open, and the confinement means to comprise the stop which has an annular and conical end, forming a leaktight seat, in contact with a conical peripheral part of the piston, in the rest position of the pump, the stop delimiting with the pump body, at least one passage allowing air to pass from the outside of the device towards the channel for air intake as soon as the piston is separated from the conical end of the stop, when the pump is actuated.

In this variant, it is insufficient to remove the removable cap, generally provided with this type of device, in order to admit air into the volume between the containers, but the pump must be actuated. Moreover, for as long as it is not actuated, and even if the cap is removed, the confinement of the vapors and gases originating from the product in the inner container, and which was able to cross into the volume between the two containers, is provided by the interaction of the stop with the piston, in the rest position.

When the leaktight means for mounting the pump on the neck of the inner container comprises an annular seal surrounding the pump body and held between the latter and this neck, it is advantageous, according to a further variant of the device of the invention, for the orifice for air intake of the inner container, which passes through the neck of the latter outside the seal, to be in permanent communication, firstly, with the passage for air intake of the outer container (passing through its neck) and, secondly, with an annular space delimited between the pump body and the neck of the inner container and into which the orifice for air intake of the pump body opens out, and the confinement means to comprise the annular seal, which is elastic and substantially flat and has at least one part extending into the annular space and forms a non-return valve by pressing elastically against the pump body in the position in which its orifice for air intake is closed off when the pump is not in a phase of pumping a metered amount of product out of the internal volume of the inner container, whilst the seal flexes elastically towards the inside of the annular space and clears the orifice for air intake of the pump body in order to place the outside of the device in communication with the volume between the containers through the effect of the reduced pressure produced in this volume between the two containers in the phase of pumping a metered amount of product out of the internal volume of the inner container.

Thus, the outside air can penetrate into the volume between the two containers by passing through the orifice for intake of air made in the pump body and by pushing back the seal forming a valve, but the gases and vapors cannot escape in the other direction because their pressure gives rise to closure of the orifice for intake of air of the pump by pressing the seal against this orifice, or adds its effects to the inherent elasticity of the seal in order to return to a position in which it closes off the orifice for intake of air of the pump body.

Thus, evaporation of the product through the deformable container is halted as soon as saturation is reached in the volume located between the two containers. As this volume is a space closed by the seal forming a valve or extended by a closed space delimited by the cap or by the interaction of the pump piston and its stop, according to the variants, and only the outside air can penetrate into this volume between the containers, whereas no gas and no vapor can leak from it towards the outside, it is also advantageous for this volume between the containers to contain at least one chemical body or a substance capable of fixing a gas and/or a vapor contained in the outside air admitted into this volume in order to prevent diffusion of this gas or of this vapor through the wall of the inner container and towards the product in the internal volume of the latter. By way of example, this chemical body may fix oxygen from the air or water vapor contained in the outside air, the diffusion of which towards the inside of the deformable container, through the wall of the latter, would result in degradation of the products which are sensitive to oxidation or to moisture.

The second object of the invention, namely the use of special wall shapes making it possible to use the plastic injection technique in order to manufacture deformable containers, is achieved through the fact that the inner container, made from plastic, has a general cylindrical shape with a closed bottom at an end opposite that made as an open neck extending its thin-walled deformable body equipped with longitudinal ribs projecting inwards and of a thickness and/or width decreasing progressively from the bottom towards the neck. This structure of the thin-walled deformable container permits demoulding of the internal part and the shape of the longitudinal ribs promotes passage of the molten plastic during injection of the piece. Thus, it is possible to mould containers with a very thin wall which can be deformed easily without using a high injection pressure.

When using a deformable container produced in this way in the packaging device of the invention, the embossed ribs make it possible to arrange for different parts of the wall of the deformable container not to stick to one another and not to trap a portion of the product in a space it would be impossible to empty. Moreover, the cylindrical shape of the deformable container with a thin and flexible wall permits its easy insertion without deformation into the rigid outer container which protects it.

Advantageously, the outer container is also made from plastic and has a general cylindrical shape, and the rigid wall of its body is equipped with longitudinal grooves made in its inner face and at least one of which extends, from the neck towards the bottom of this container, at least one groove forming a passage for air intake in the neck of the rigid container. This structure of the outer container is advantageous in that it makes it possible to mould it by injection, without a considerable increase in its thickness. Advantageously, so that the two containers can be assembled in the factory, and to prevent them separating from each other during transportation, provision is made for the necks of the outer and inner containers to be provided with projections and/or hollows having complementary shapes for coupling, permitting fastening of the two containers on each other via their neck after insertion of the inner container into the outer container, the neck of which has an internal diameter greater than the diameter of the inner container so as to permit easy insertion of the latter into the outer container. This fastening may be obtained by wedging and/or elastic nesting through the interaction of the complementary shapes of the complementary projections and/or hollows of the necks.

BRIEF DESCRIPTION OF THE DRAWINGS

Further characteristics and advantages of the invention emerge from the description given below, with reference to the appended drawings which represent, by way of non-limiting examples, embodiments and forms of implementation of the subject of the invention. In these drawings.

DESCRIPTION OF THE PREFERRED EMBODIMENTS

In the various figures, similar or corresponding elements have been given the same reference numbers.

Figure 1:
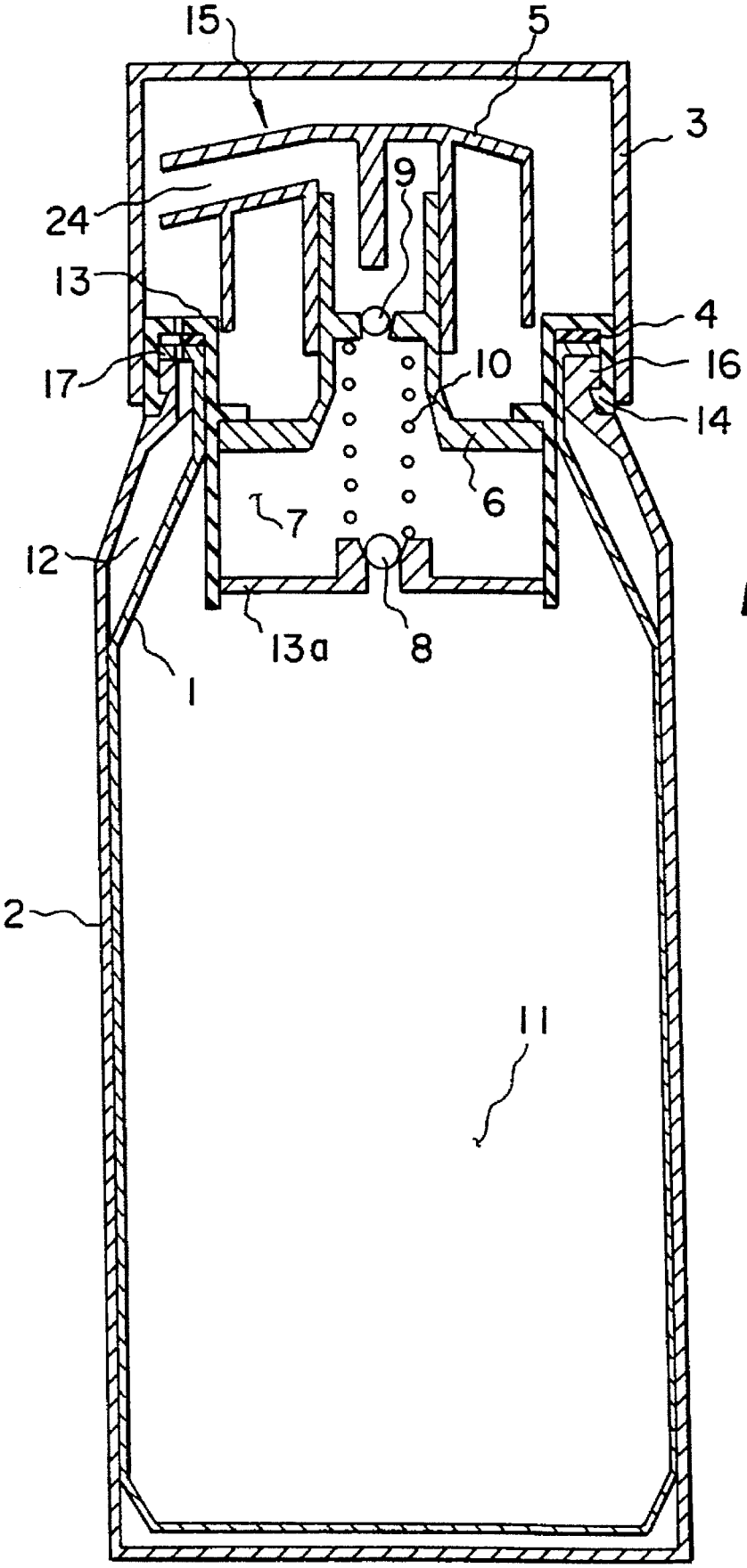
FIG. 1 is a diagrammatic view in axial section of a first example of a device according to the invention, including a deformable inner container and a protective outer container with which a manual pump for dispensing individual metered Mounts of a product contained in the deformable container interacts.

As represented in FIG. 1, the packaging and dispensing device comprises a deformable inner container 1, the body of which includes a flexible plastic wall of small thickness, and which is mounted in a rigid outer container 2, a pump 15, of the type without intake of air, being assembled on the open necks 17 and 16 of the containers 1 and 2, respectively.

This pump 15 comprises a body 13 having a cylindrical central part, in which a piston 6 slides, having a central shaft via which the piston 6 is displaced by a plunger 5 equipped with a dispensing conduit 24. A first valve 8 interacts with a seat around the central opening in the bottom 13*a* of the central part of the body 13, in order to isolate the internal volume of the chamber 7, delimited between the piston 6 and the bottom 13*a* of the body 13, from the internal volume 11 of the deformable container 1. A second valve 9 interacts with a seat formed around the central opening of an annular stop provided in the shaft of the piston 6 in order to act as a stop for a return spring 10, so that the second valve 9 can isolate the chamber 7 from the outside, by means of the inner conduits of the plunger 5. The spring 10, extending in the chamber 7 between the two valves 8 and 9, returns the piston 6 to the rest position, against a stop projecting radially towards the inside of the cylindrical part of the body 13.

This cylindrical part of the body 13 is engaged inside the open neck 17, which is more rigid than the body of the deformable container 1, and an annular seal 4 is mounted around the pump body 13 and between a folded-down lip of the latter and the neck 17 of the inner container 1, which neck 17 is pressed inwards and against the upper face of the neck 16 of the rigid container 2. Sealing between the body 13 of the pump 15 and the neck 17 of the deformable container 1 is thus provided by the seal 4. The folded-down lip of the body 13 is equipped with a peg 14, projecting towards the inside of the body 13 and permitting fastening of the body 13 over a corresponding peg, on the neck 16 of the outer container 2, projecting towards the outside of the latter.

Figure 2:
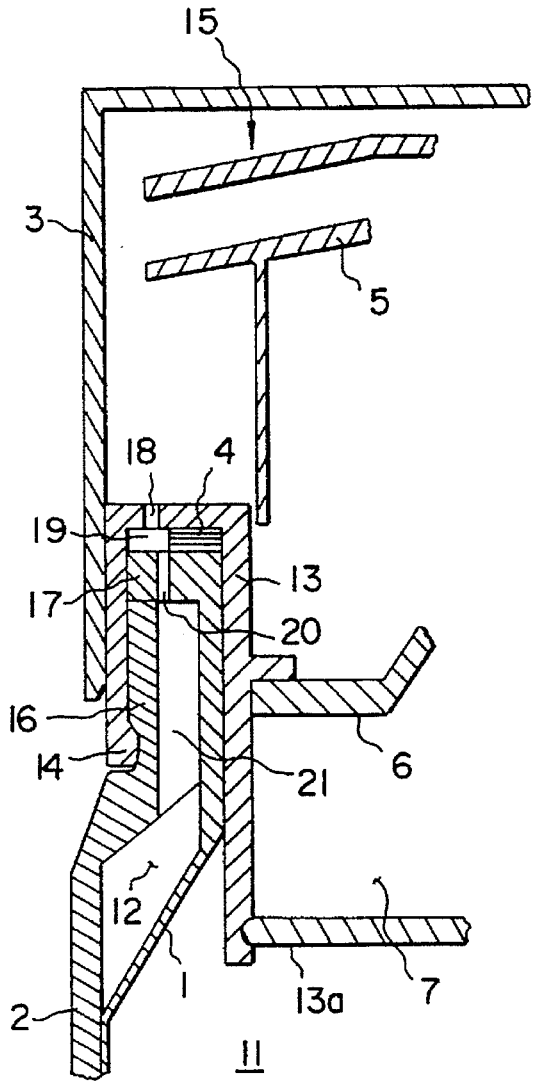
FIG. 2 is an enlarged view in partial section representing the passage and orifices for the intake of outside air via the pump and the necks of the containers of a device similar to that in FIG. 1.

This mounting of the pump 15 on the necks 16 and 17 of the containers 2 and 1 appears in greater detail in FIG. 2, which also shows an orifice 18 made in the lip of the body 13 and in permanent communication with an annular volume 19 delimited between the lip of the body 13 and the neck 17 of the deformable container 1, in order to accommodate the seal 4. This annular volume 19 is itself in permanent communication with an orifice 20 made in the neck 17 of the deformable container 1, radially outside the seal 4, like the orifice 18 of the body 13. This orifice 20 opens out in grooves 21 made, for example axially or longitudinally, in the neck 16 of the rigid container 2, which are themselves in permanent communication with the volume 12 delimited between the two containers 1 and 2.

Thus, the orifice 18, the volume 19, the orifice 20 and the grooves 21 delimit, successively or continuously, a channel for the intake of air, which is permanently open between the outside of the pump 15 and of the containers 1 and 2, and the volume 12 delimited between these containers 1 and 2.

Finally, a leaktight cap 3 is fastened removably and in a leaktight manner, for example by elastic nesting, around the pump 15 and the necks 16 and 17 of the containers 1 and 2.

The device, the structure of which has just been described, operates in the following manner: with the cap 3 of the pump 15 removed, a manual pressure exerted by the user on the plunger 5 successively opens the valve 9 via a central rod of the plunger 5, then displaces the piston 6 against the spring 10 towards the bottom 13*a* of the body 13, which enables the product contained in the chamber 7 to escape towards the outside by using the central shaft of the piston 6 and then the conduit 24 of the plunger 5, whilst, simultaneously, the valve 8 is closed, this preventing any backflow of the product contained in the chamber 7 towards the inside 11 of the deformable container 1.

A metered amount of product is thus dispensed towards the outside.

When the manual pressure on the plunger 5 is no longer being exerted, the spring 10 returns the piston 6 to its initial rest position, pressing against the stop in the body 13, and the upper valve 9 closes, which prevents any intake of outside air into the chamber 7, and, conversely and simultaneously, the lower valve 8 opens, which enables a further metered amount of product to enter into the chamber 7 originating from the internal volume 11 of the inner container 1.

This suction of the product from the volume 11 creates a reduced pressure inside this volume 11, the consequence of which is to give rise to a contraction of the deformable container 1 in order to offset the loss in volume.

This deformation of the container 1 itself gives rise to suction in the volume 12 delimited between the two containers 1 and 2 and it is necessary to allow air to enter from the outside in order to offset this reduced pressure. As the cap 3 is removed, the outside air passes via the orifice 18, then through the annular space 19, then via the orifice 20 and, finally, penetrates into the volume 12, using the passage created by the grooves 21 in the neck 16 of the rigid container 2.

Between two uses of the device, or during storage of the product in the packaging device, before its use, a certain evaporation of a volatile phase of the product, or even a certain migration of part of the product, may take place through the thin wall of the body of the deformable container 1. This evaporation and/or migration, due to the permeability of the plastic of small thickness which constitutes this wall, gives rise to an accumulation of vapors and/or gases, or even of product, in the volume 12 between the containers 1 and 2 and generates an increase in pressure therein.

These gases and/or vapors tend to use the path which is the reverse of that used by the outside air when a reduced pressure is created in this same volume 12. This reverse path is halted by the cap 3, which is leaktight and is fastened in a leaktight manner over the body 13 of the pump 15, since this cap 3 is located on the device between two uses or before use of the latter.

The cap 3 thus constitutes a means for confining gases and/or vapors which could accumulate in the volume 12 between the containers 1 and 2, since this volume 12 is in permanent communication with the inside of the cap 3, mounted on the device, via the channel for the intake of air formed by the orifices and passage 18, 19, 20 and 21.

Figure 3:
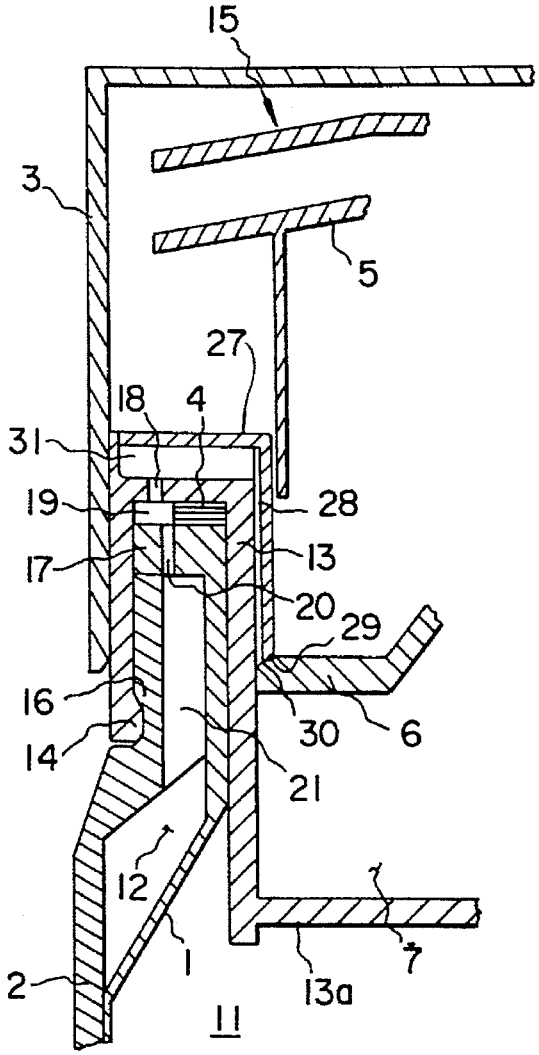
FIGS. 3 and 4 are views similar to FIG. 2 for a second and a third illustrative embodiment of the device, respectively.

In the variant in FIG. 3, the stop of the body 13 of the pump 15, against which the spring 10 returns the piston 6 when the pump is not actuated, is a piece 27 including a cylindrical part engaged in the body 13 and a radial annular part, and this piece 27 is secured to the body 13 by clamping in the latter. This stop 27 includes, in its cylindrical part, longitudinal or axial grooves 28, in its face turned towards the body 13, and this part of the stop 27 terminates, on the piston 6 side, in an annular end 29 of conical shape which constitutes a seat collaborating with a peripheral part 30, which is also conical, on the piston 6, so that the conical end 29 of the stop 27 and the conical part 30 of the piston 6 close the lower end of the grooves 28 in a leaktight manner when the piston 6 is returned by the spring 10 into the rest position, and so that the lower end of the grooves 28 is open towards the outside of the pump 15 when the piston 6 is not in the rest position, because the plunger 5 is being or has been pushed down. That end of the grooves 28 which is opposite the conical end 29 is in permanent communication with a volume 31, delimited between the lip of the body 13 and the annular radial part of the stop 27 and into which the orifice 18 made in the body 13 opens out, and in permanent communication, as in the preceding example, with the annular volume 19 accommodating the seal 4, the orifice 20 passing through the neck 17 of the deformable container 1 and the grooves 21 forming a passage for the intake of air in the neck 16 of the rigid container 2, thus delimiting a channel for admitting air which is permanently open and opens out into the volume 12 between the containers 1 and 2.

Thus, the gases and/or vapors accumulated in the volume 12, originating from the product inside the deformable container I and which have passed through its wall, and which would like to escape towards the outside via the grooves 21, the orifice 20, the volume 19 and the orifice 18, are confined in the volume 31 and the grooves 28 delimited between the body 13 and the stop 27, whilst the pump 15 is not used and the piston 6 presses in a leaktight manner via its conical part 30 against the conical end 29 of the stop 27. Moreover, during use of the pump 15, the piston 6 is not in contact with the stop 27, the lower end of the grooves 28 is no closed off and the outside air can use the passage delimited by the grooves 28, the volume 31 and the channel 18-19-20-21 for admitting air in order to penetrate into the volume 12 and offset the reduced pressure created in this volume by operation of the pump 15.

Figure 4:
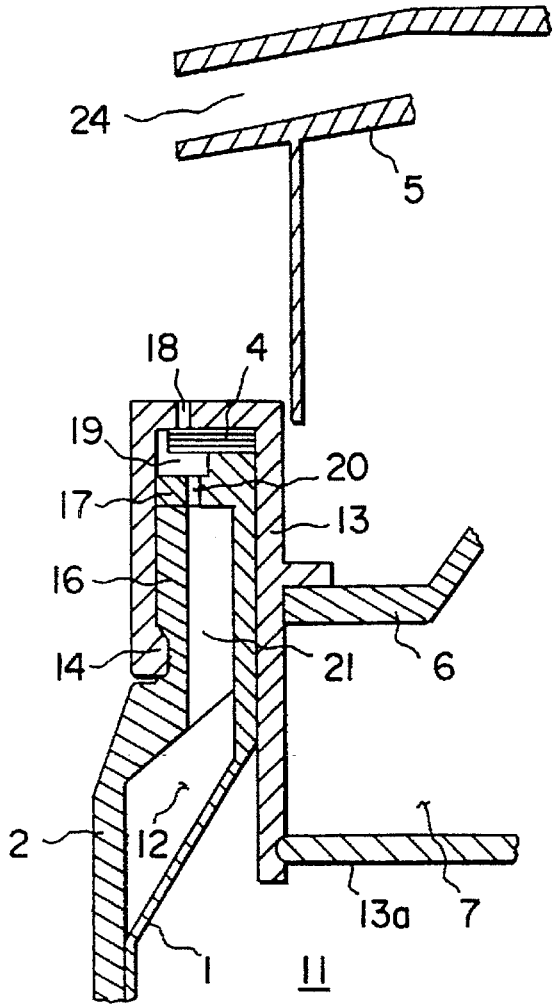

In the variant in FIG. 4, unlike the embodiments in FIGS. 2 and 3, the orifice 18 in the body 13 of the pump 15 is not directly connected to the annular space 19 accommodating the seal 4, but is separated from the space 19 by a part of this seal 4 which is annular, elastic and flat and which presses by means of its natural elasticity against the body 13, closing off the orifice 18. For the rest, it will be seen that the space 19 is in permanent communication with the orifice 20 in the neck 17 of the deformable container 1, the orifice 20 itself being in permanent communication with the grooves 21 made in the neck 16 of the rigid container 2, in order to open out into the volume 12 between the containers 1 and 2.

Through the effect of a reduced pressure in this volume 12, suction develops in the grooves 21, the orifice 20 and the space 19 and, through the effect of this suction, the outer radial part of the seal 4, which closes off the orifice 18, is flexed towards the inside of the space 19 and clears the orifice 18, thereby permitting an intake of air from the outside towards the volume 12. Moreover, any pressure developing in the space 19 via the orifice 20 and the grooves 21, owing to the gases and/or vapors present in the volume 12, has the effect of squashing the seal 4 against the body 13, closing off the orifice 18, and does not permit the passage of these gases and/or vapors towards the outside.

In the variant of FIG. 4, the seal 4 acts as a non-return valve and permits the passage of air from the outside towards the volume 12, but prevents the leakage of the vapors and/or gases towards the outside, from this volume 12, even in the absence of the cap 3. Nor is it essential to provide a stop such as 27 in FIG. 3. The stop limiting the displacement of the piston 6 may be such as that represented in FIG. 2.

A packaging and dispensing device is thus produced in which the permeability of the wall of the deformable container 1 no longer poses a problem, since the migration and/or evaporation of part of the product contained in the internal volume 11 of the deformable container 1 is halted when saturation is reached in the volume 12 located between the containers 1 and 2.

It should be noted that this result is achieved without the addition of additional pieces.

If it is feared that a gas, such as oxygen, or a vapor, such as water vapor, present in the air contained in the said volume 12, outside the deformable container 1, may be able to diffuse through the thin wall of this container 1 and present a risk of oxidation or moistening vis-à-vis the product located therein, a simple remedy to this problem consists in inserting, into the volume 12 before the pump 15 is fitted on the necks 16 and 17 of the containers 1 and 2, a substance or a chemical body capable of fixing or absorbing this gas or this vapor.

In the variant of FIG. 4, in particular, the seal 4, forming a non-return valve, prevents any leakage of this substance or of this chemical body towards the outside of the device and also prevents any exchange with the outside capable of saturating this substance or this chemical body which absorbs oxygen or water vapor.

Figure 5:
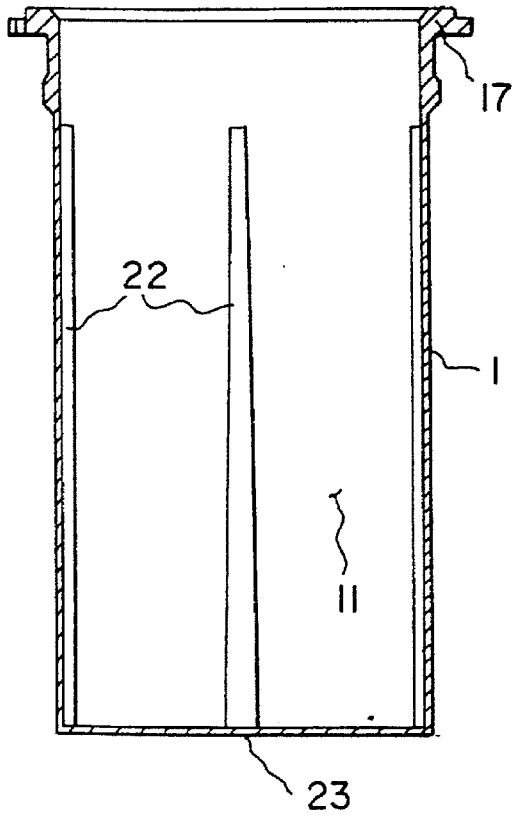
FIG. 5 is a diagrammatic view in axial section of a deformable container which can be used in a device according to the invention.

FIG. 5 represents, in axial section, an advantageous embodiment of the deformable container 1 which has been given a cylindrical shape so as to permit its manufacture with a thin flexible wall for its body, by means of moulding using the plastic injection technique. The inner volume 11 of the deformable container 1 is obtained, in the moulding equipment, by means of a core, the cylindrical shape of which permits demoulding without undercut. In the example of FIG. 5, the flexible thin wall of the cylindrical body of the deformable container 1 has, on its inner face and projecting radially inwards, longitudinal ribs 22 which, on the one hand, facilitate the passage of the plastic during injection, from an injection point located at the level of the closed bottom 23, opposite the neck 17 of this container 1, and which, on the other hand, enable the molten plastic, during injection, more easily to fill the solid part of the neck 17 and to avoid the braking of this plastic by means of the small thickness of the wall of the cylindrical body of this deformable container 1. These ribs 22 have a width and a thickness which progressively decrease from the closed bottom 23, at the level of the injection point, and in the direction of the neck 17, because the distance of the path remaining to be covered by the plastic during injection gets less as this material approaches the neck 17.

The problem of obtaining thin-walled deformable containers 1, when they are manufactured by moulding according to the plastic injection technique, is thus solved by a structure of this container 1 which includes these ribs 22 to facilitate the passage of the injection material during moulding and which in no way interfere with the deformation of this container 1 during use.

In the absence of these ribs 22, during such use, the container 1 could be deformed in a non-controlled manner and opposite parts of its wall could stick to each other at mid-height, which would have the result of cutting off communication of the product remaining in the bottom of the deformable container 1 towards the pump 15. This phenomenon would give rise to a considerable waste of product.

The presence of the ribs 22, intended to facilitate moulding of the deformable container 1, creates a space between each rib 22 and that flexible wall part opposite it, which has the result of making a passage for the product, even if opposite wall parts come closer together.

Figure 6:
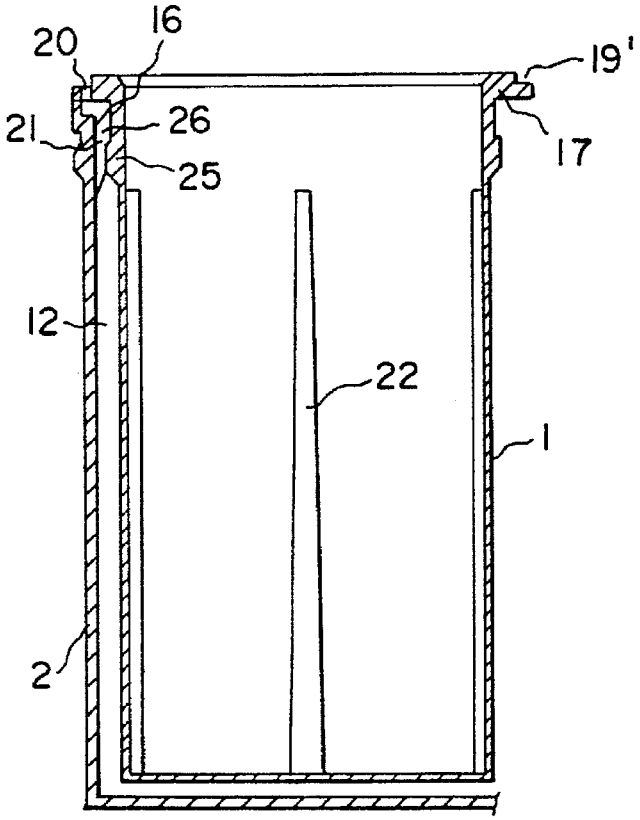
FIG. 6 is a diagrammatic view in partial axial section of the deformable container in FIG. 5, assembled in a rigid container only partially shown for clarity.

FIG. 6 is a partial representation of a preferred variant of the invention, in which the two containers 1 and 2 constitute an assembled whole, the deformable container 1 being that of FIG. 5, in which the orifice 20 passing through its neck 17 is made in the bottom of an annular shoulder 19' delimiting the annular space 19 in an embodiment such as that in FIG. 4.

In FIG. 6, the deformable container 1, of cylindrical shape, is assembled in the protective and rigid outer container 2, the neck 16 of which includes the grooves 21. The external diameter of the deformable body of the container 1 is less than the internal diameter of the neck 16 of the rigid outer container 2, which permits easy insertion of the former into the latter, without a special machine.

However, a projection 25, directed radially towards the outside of the container 1 and made in the neck 17 of the container 1, makes it possible to fasten, by elastic nesting, this container 1 in the container 2, the neck 16 of which includes a projection 26 directed towards the inside of the containers and which has an internal diameter slightly smaller than the external diameter of the projection 25 of corresponding shape and which couples with it on the inner container 1. The projection 26 of the neck 16 of the rigid container 2 may include recesses and be produced with a fluted shape, that is to say comprising vertical recesses over its entire circumference.

An assembly of two containers 1 and 2 which are easy to assemble and which cannot be detached from each other during transport has thus been produced. Clearly, the outer container 2 also advantageously has a cylindrical shape and may be moulded from plastic by means of injection, with a closed bottom.

Figure 7:
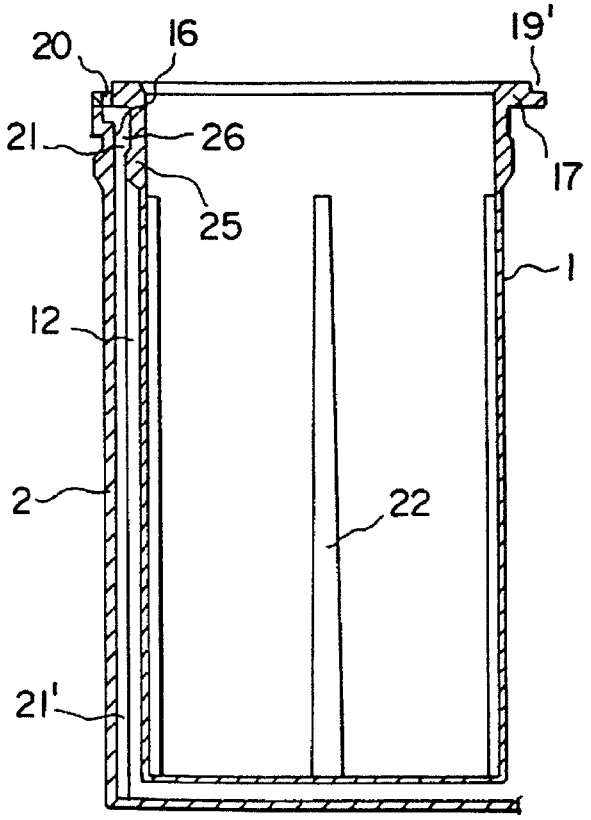
FIG. 7 is a view similar to FIG. 6, for a rigid container variant.

FIG. 7 represents a similar assembly of two containers 1 and 2 secured together by means of respective projections 25 and 26 and in which the inner face of the cylindrical body of the rigid outer container 2 has longitudinal or axial grooves 21', some of which extend, from the neck 16 towards the closed bottom of this container 2, the grooves 21 delimited for the passage of air into the neck 16 via the projection(s) 26 of the latter.

This configuration makes it possible to mould the rigid container 2 using the plastic injection process, the particular shape of the projection 26 and of the grooves 21 and 21' reducing the undercut part of the core in the mould and permitting easier demoulding.

It should be noted that the containers 1 and 2 may be attached via their necks 16 and 17 by means of other embodiments of projections and/or hollows of complementary shapes without thereby departing from the scope of the invention. For example, an embossed projection on the neck 16 of the rigid container 2 may interact for this purpose with a hollowed-out groove in the neck 17 of the deformable container 1.

I claim:

1. A device for packaging and dispensing a product comprising:

a rigid outer container having an open neck and a closed bottom;

a deformable inner container having a body and an open neck which is more rigid than said body, said inner container being accommodated inside of the outer container with a volume provided therebetween and containing a product to be packaged and dispensed;

a manual pump which operates without air intake into said inner container to dispense the product in individual metered amounts, said pump having a body which is mounted on said necks of said inner container and said outer container;

a leaktight means for sealing said manual pump in a leaktight manner with the neck of said inner container on which said pump is mounted;

a channel which provides external air intake into the volume between said inner container and said outer container at least when said pump is actuated, said channel including (a) at least one air intake passage located outside of said leaktight means and located at least partially in one of said necks of said outer container and said inner container and (b) at least one orifice in said body of said pump located outside of said leaktight means; and a confining means for preventing any part of the product passing through the body of said deformable inner container and into the volume between said inner container and said outer container from escaping through said air intake passage at least when said pump is not actuated.

2. A device as claimed in claim 1:

wherein said passage and said orifice are in constant communication with one another so that said channel for air intake is permanently open; and wherein said confining means includes a leaktight cap fixed removably and in a leaktight manner around said pump and said necks of said inner and outer containers so as to enclose said channel.

3. A device as claimed in claim 1:

wherein said passage and said orifice are in constant communication with one another so that said channel for air intake is permanently open;

wherein said pump includes (a) a piston, (b) a stop attached to said body of said pump, (c) an elastic return means for returning said piston to a rest position against said stop, (d) a plunger which is manually actuated to move said piston away from said stop and in opposition to said return means during actuation of said pump, and (e) a second passage provided between said body of said pump and said stop which permits passage of external air to said channel; and wherein said confining means includes (a) a leaktight seat formed by an annular and conical end of said stop and (b) a conical peripheral part of said piston which is in contact with said leaktight seat when said piston is in the rest position to prevent external air from entering said second passage and hence said channel and which is out of contact with said stop when said plunger is manually actuated so that external air is permitted to flow through said second passage and said channel to the volume.

4. A device as claimed in claim 3:

wherein said pump further includes a second volume provided between said stop and said body of said pump which is in communication with said channel; and wherein said second passage is formed by at least one groove in said stop which extends from said second volume to said conical end of said stop such that external air is free to pass through said second passage as soon as said piston is moved away from said stop.

5. A device as claimed in claim 1:

wherein said leaktight means is an annular seal which is flat and elastic, said seal surrounding the body of said pump and being provided between the body of said pump and said neck of said inner container;

wherein said channel includes, in permanent communication, said orifice which is provided in said neck of said inner container, a second passage located in said neck of said outer container, and an annular space provided between said pump body and said neck of said inner container into which said orifice opens out; and wherein said confining means includes a non-return valve formed by a part of said annular seal extending into said annular space and pressing elastically against said pump body in a position at which said orifice in said pump body is closed off when said pump is not actuated and which said part flexes elastically towards an inside of said annular space and opens up said orifice when said pump is actuated and a reduced pressure is produced in the volume between said inner and outer containers due to a pumping of product out of said inner container.

6. A device as claimed in claim 1 and further including at least one chemical body capable of fixing one of a gas or vapor contained in external air admitted into the volume whereby diffusion of the one of the gas or vapor through said inner container to the product is prevented.

7. A device as claimed in claim 1:

wherein said inner container is made from plastic and has a general cylindrical shape with a closed bottom at an end opposite from said open neck of said inner container;

wherein said body of said inner container is thinner than said neck of said inner container; and wherein said body of said inner container includes longitudinal ribs projecting inward, said ribs having one of a thickness or width which progressively decreases from the bottom towards said neck of said inner container.

8. A device as claimed in claim 1 wherein said outer container is made from plastic and has a general cylindrical shape with a rigid longitudinal wall, said wall having longitudinal grooves along an inner face thereof with one of said longitudinal grooves extending from said neck of said outer container toward the closed bottom and forming a passage for air intake in said neck of said outer container.

9. A device as claimed in claim 1:

further including a fastening means for fastening of said necks of said inner and outer containers together when said inner container is inserted in said outer container; and wherein said neck of said outer container has an internal diameter greater that a diameter of the body of said inner container to provide for an easy insertion of said body of said inner container into said outer container.

10. A device as claimed in claim 9 wherein said fastening means includes first and second elements having complementary shapes and provided respectively on said necks of said inner and outer containers.

11. A device as claimed in claim 10 wherein said elements are selected from one of projections, hollows, or projections and hollows.

12. A device as claimed in claim 1 and further including a fastening means for fastening said body of said manual pump to said neck of said outer container.

13. A device as claimed in claim 12 wherein said fastening means is a peg provided on said body of said manual pump and a corresponding peg provided in said neck of said outer container whereby said peg on said body is fastened over said peg on said neck.

* * * * *